US008121521B2

(12) United States Patent
Bateman, III

(10) Patent No.: US 8,121,521 B2
(45) Date of Patent: Feb. 21, 2012

(54) SUPPORT STRUCTURE FOR A PHOTOCONDUCTIVE DRUM OF A PRODUCTION PRINTING SYSTEM

(75) Inventor: William Bateman, III, Longmont, CO (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 386 days.

(21) Appl. No.: 12/471,012

(22) Filed: May 22, 2009

(65) Prior Publication Data

US 2010/0296838 A1 Nov. 25, 2010

(51) Int. Cl.
*G03G 15/00* (2006.01)

(52) U.S. Cl. ..... 399/117; 399/116; 492/47

(58) Field of Classification Search ..... 399/116, 399/117; 492/47

See application file for complete search history.

(56) References Cited

U.S. PATENT DOCUMENTS 4,561,763 A * 12/1985 Basch ..... 399/116
4,751,776 A * 6/1988 Reunamaki ..... 492/47
5,042,734 A * 8/1991 Angelucci et al. ..... 492/16
5,461,464 A 10/1995 Swain
6,556,796 B1 * 4/2003 Chavez et al. ..... 399/110
6,907,205 B2 6/2005 Himes et al.
7,116,927 B2 10/2006 Choi
2005/0078979 A1 4/2005 Yoo et al.
2007/0237545 A1 10/2007 Cho et al.
2008/0240777 A1 10/2008 Kwon
2008/0279584 A1 11/2008 Huang et al.

* cited by examiner

*Primary Examiner* — David Porta
*Assistant Examiner* — Yara Green
(74) *Attorney, Agent, or Firm* — Duft Bornsen & Fishman, LLP

(57) ABSTRACT

A drum support structure of a production printing system is disclosed. The drum support structure secures a photoconductive drum within a printing system during operation. The drum support structure includes a plurality of ring members spaced in parallel along a longitudinal axis. The ring members have an outside diameter that corresponds with an inside diameter of the drum so that the ring members fit within the drum. The drum support structure also includes a plurality of connecting members that affix the ring members to one another. The drum support structure also includes an inner end cap that connects to an inner-most ring member through one or more connecting members and is adapted to contact one end of the drum. The drum support structure also includes an outer end cap that is adapted to fasten to an outer-most ring member and is further adapted to contact another end of the drum.

20 Claims, 18 Drawing Sheets

SUPPORT STRUCTURE FOR A PHOTOCONDUCTIVE DRUM OF A PRODUCTION PRINTING SYSTEM

BACKGROUND

1. Field of the Invention

The invention relates to the field of production printing systems and, in particular, to a support structure for a photoconductive drum of a printing system.

2. Statement of the Problem

Businesses or other entities having a need for volume printing typically purchase a production printing system. A production printing system comprises a high-speed printer used for volume printing, such as 100 pages per minute or more. The production printing systems are typically continuous-forms printers that print on paper or some other printable medium that is stored on large rolls. Some continuous-forms printers are able to print on paper up to 20 inches wide or more.

One type of high-speed printer is a laser printer. The core component of a laser printer is the photoreceptor, which is typically a revolving drum or cylinder. The photoreceptor is made out of highly photoconductive material that is discharged by light photons, and is often referred to as a "photoconductive drum" or simply a "drum". Depending on the throughput of a laser printer, the photoconductive drum may have to be replaced quite often, such as every couple weeks. Unfortunately in many production-type laser printers, the task of replacing the drum is quite burdensome. First, tools are needed to replace the drum, such as a drum extension rod and wrenches. Secondly, the process of removing the old drum and installing a new drum requires some skill and time. The availability of the tools and the time and skill involved in replacing the drum typically does not allow a customer to replace the drum. Thus, a service engineer may have to be called to the customer's site to replace the drum, which may be costly to the customer.

SUMMARY

Embodiments described herein allow for easier and faster replacement of a drum in a laser production printing system. One embodiment comprises a drum support structure that secures a photoconductive drum within a printing system during operation. The drum support structure includes a plurality of ring members spaced in parallel along a longitudinal axis. The ring members have an outside diameter that corresponds with an inside diameter of the photoconductive drum so that the ring members fit within the photoconductive drum. The drum support structure also includes a plurality of connecting members that affix the ring members to one another. The drum support structure also includes an inner end cap that connects to an inner-most ring member through one or more connecting members and is adapted to contact one end of the drum. The drum support structure also includes an outer end cap that is adapted to fasten to an outer-most ring member and is further adapted to contact another end of the drum. When the outer end cap is fastened to the outer ring member, and the photoconductive drum is pressed between the inner end cap and the outer end cap and secured.

If the drum support structure described above is used to secure a photoconductive drum in a printing system, the photoconductive drum may be replaced more efficiently than in prior printing systems. Due to the configuration of the drum support structure, the drum support structure may be partially cantilevered out of the printing system on a drum axle. Even while cantilevered, the drum support structure stays on its original longitudinal axis on the drum axle so that it does not contact other components within the printing system. The photoconductive drum may then be removed by detaching the outer end cap from the outer ring member, and pulling the photoconductive drum from the drum support structure. This may be done without having to remove the drum support structure from the printing system. A new photoconductive drum may then be slid onto the drum support structure while it is cantilevered out, and the outer end cap may again be fastened to the outer ring member. The fastening of the outer end cap to the outer ring member secures the new photoconductive drum between the inner end cap and the outer end cap. The drum support structure with the new photoconductive drum may then be slid back into to the printing system. Thus, no tools are needed to replace the photoconductive drum, which saves time and means that most customers will be able to change the photoconductive drums themselves. There may be no need for a service engineer to come out to the customer site to replace the photoconductive drum, which saves the customer on service costs. All of this results in the customer having less down time in replacing a photoconductive drum within a printing system.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended aid in understanding the principles of the invention, and are to be construed as being without limitation to such specifically recited examples and conditions. As a result, the invention is not limited to the specific embodiments or examples described below, but by the claims and their equivalents.

Figure 1:
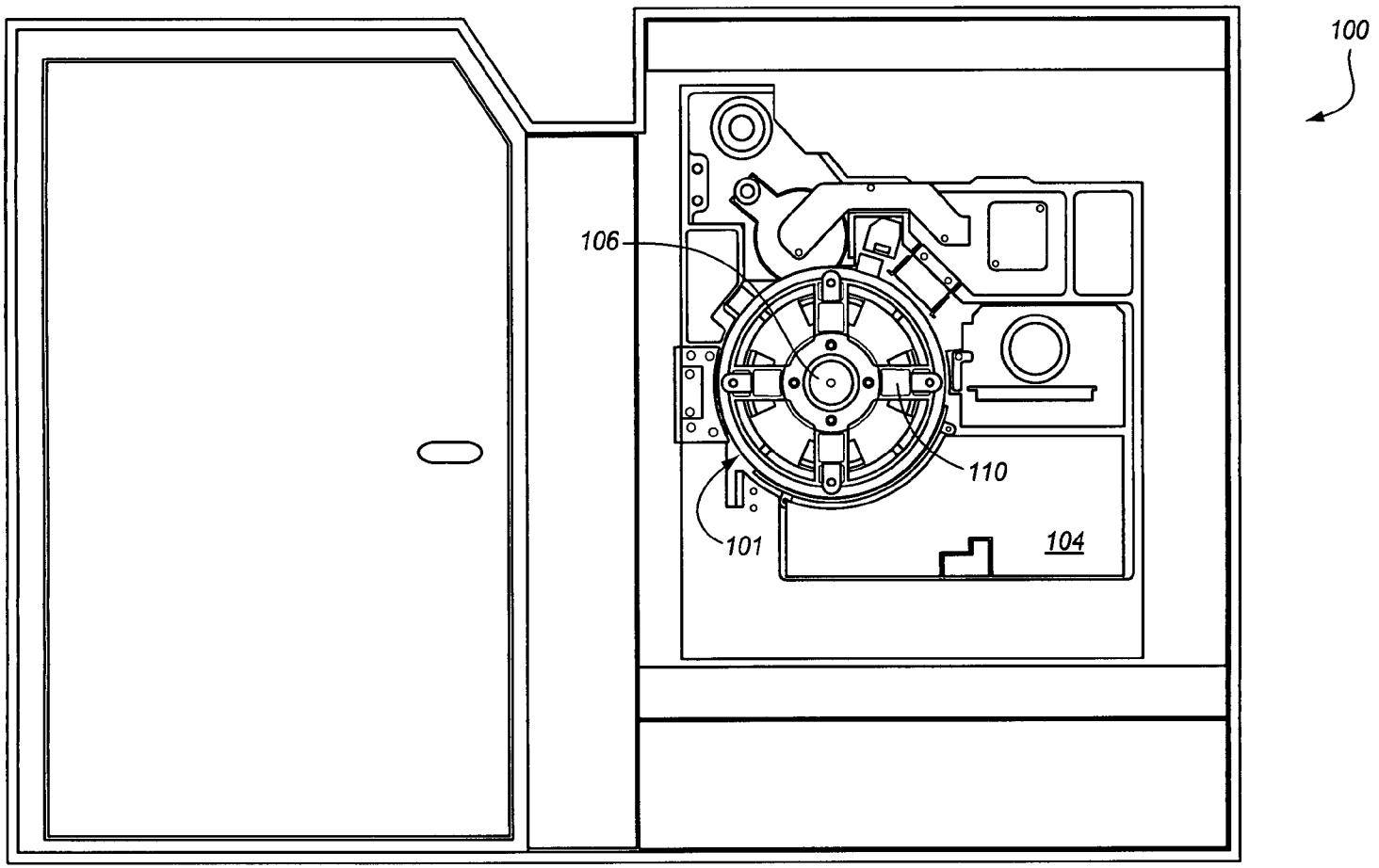
FIG. 1 PRIOR ART
FIG. 1 illustrates a production printing system.

FIG. 1 illustrates a production printing system 100. Printing system 100 includes many parts that are used for printing on a medium that are known to those skilled in the art. For the sake of brevity, the components in printing system 100 that are relevant for this discussion are drum assembly 101 and developer 104. Drum assembly 101 includes an outer cylindrical member referred to as a photoconductive drum (not visible in FIG. 1). The photoconductive drum is the member that has a photoconductive outer surface. Drum assembly 101 also includes a drum support structure 110. Drum support structure 110 contacts the ends of the photoconductive drum to support the drum within printing system 100. A more clear illustration of drum assembly 101 may be seen in FIG. 6. Developer 104 is in a fixed position with respect to drum assembly 101, meaning that it does not drop down in printing system 100. There is a very small spacing between drum assembly 101 and developer 104.

Drum assembly 101 is mounted on a drum axle 106 (or drum shaft) and is operable to rotate along with drum axle 106 when in operation. Some portion of drum assembly 101 mates with a drive mechanism (not visible) within printing system 100 that is able to rotate drum assembly 101 at a desired rotation speed. The mounting of drum assembly 101 on drum axle 106 keeps drum assembly 101 on an axis so that it doesn't contact and damage other components proximate to drum assembly 101, such as developer 104.

Figure 2:
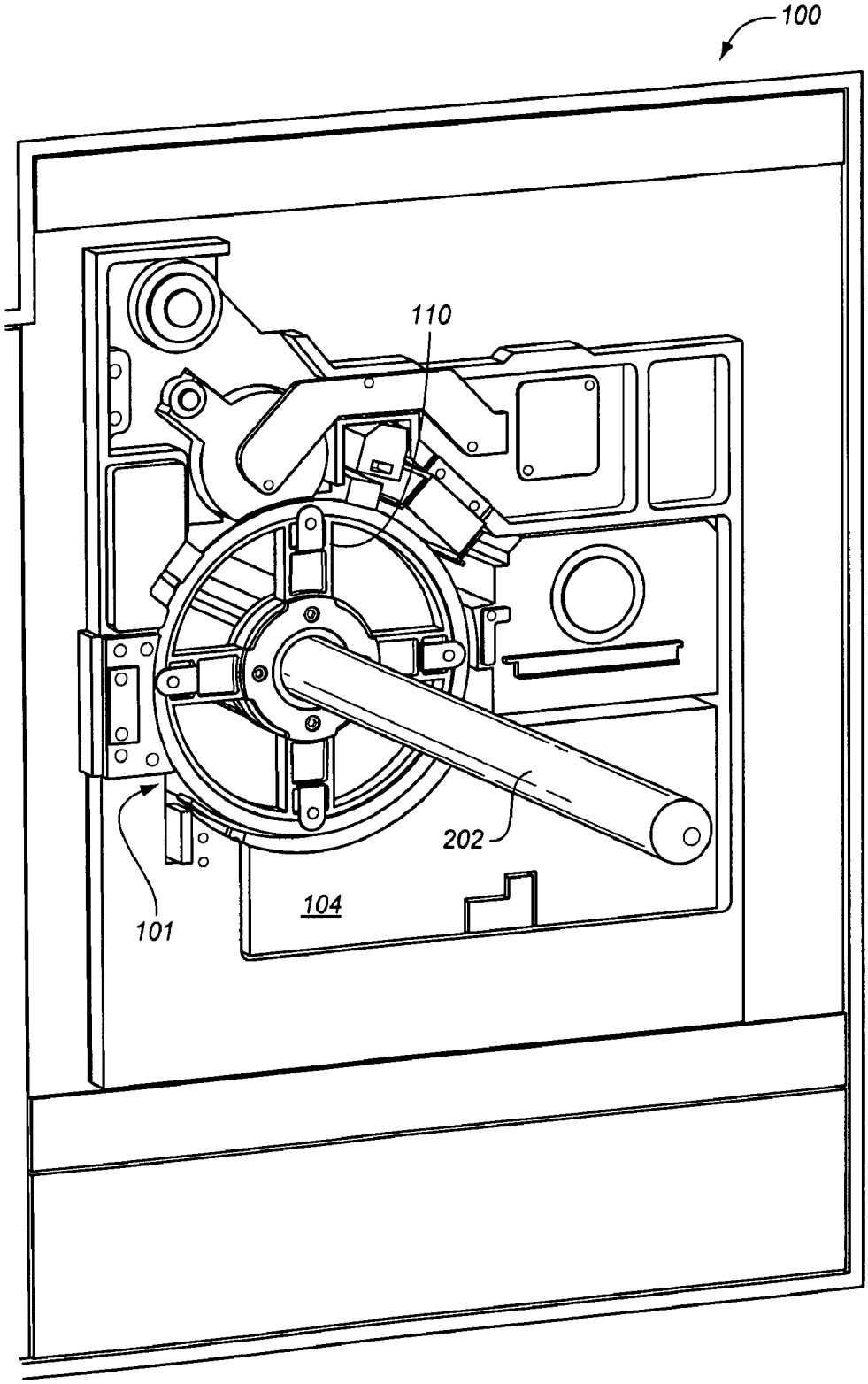
FIG. 2 PRIOR ART
FIG. 2 illustrates a drum extension rod connected to a drum axle.
Figure 3:
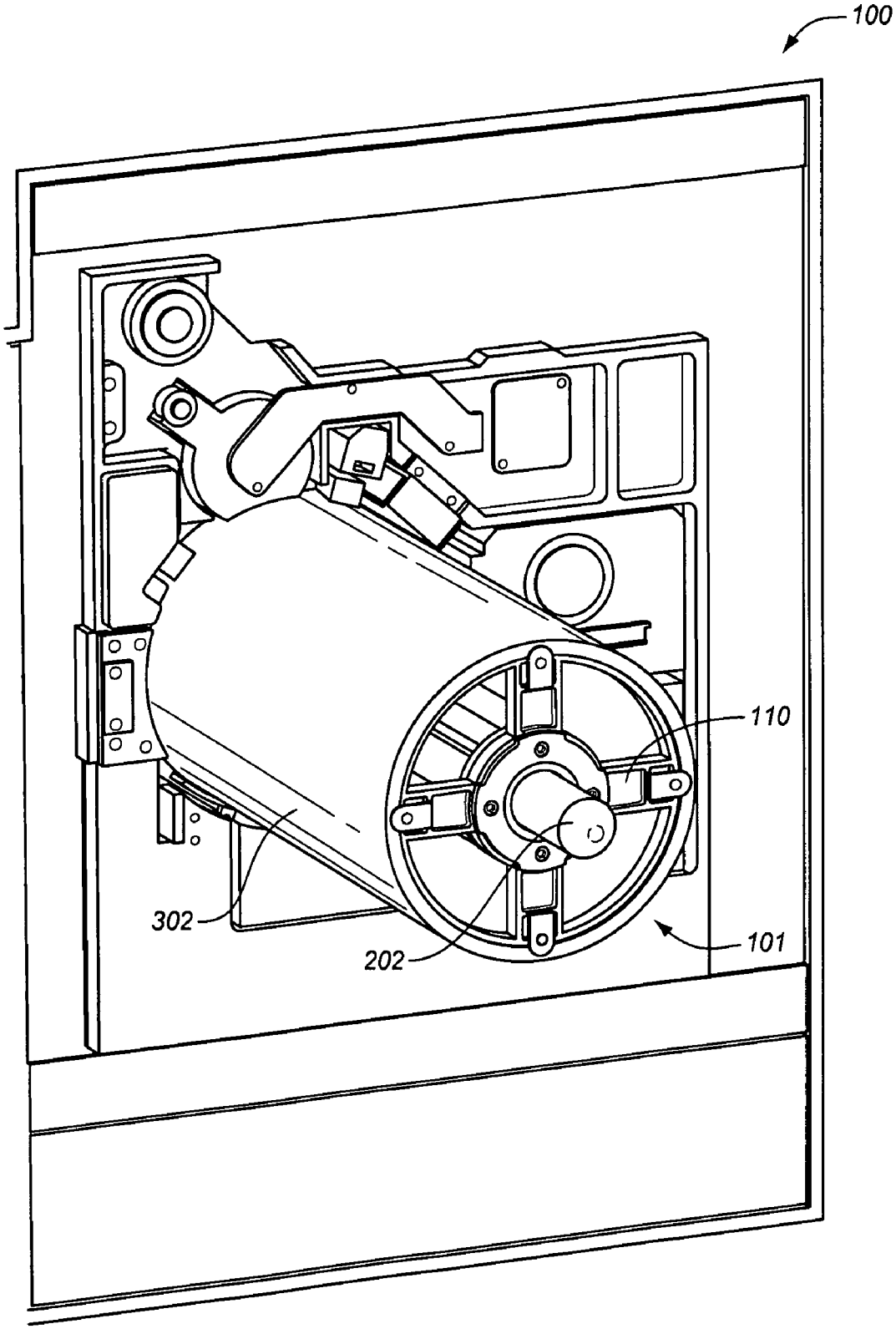
FIG. 3 PRIOR ART
FIG. 3 illustrates a drum assembly slid out onto a drum extension rod.
Figure 4:
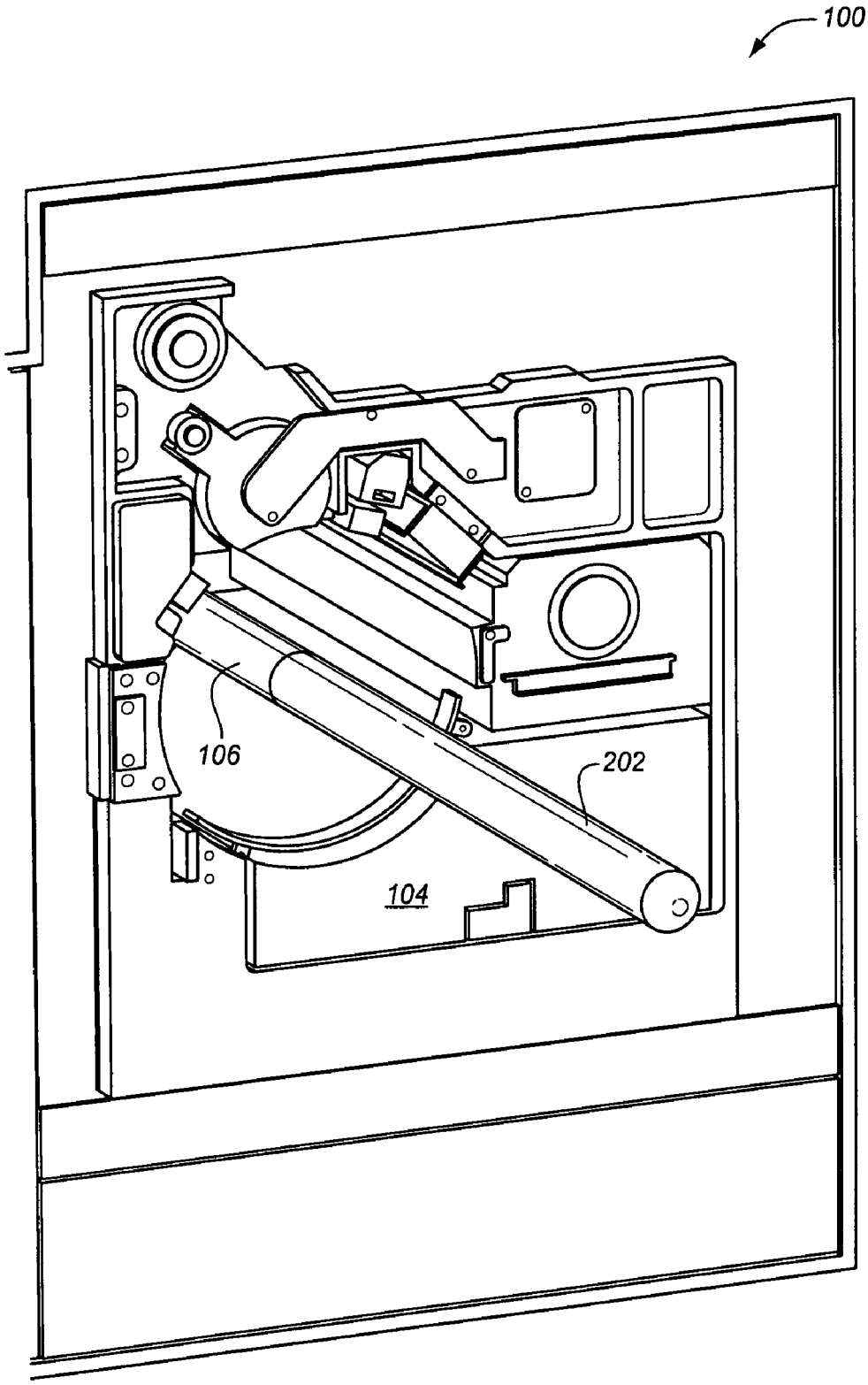
FIG. 4 PRIOR ART
FIG. 4 illustrates the printing system with a drum assembly removed.

As stated in the Background, the photoconductive drum will wear out with continued use and frequently requires replacing. FIGS. 2-6 illustrate how the photoconductive drum is traditionally replaced. To start, a drum extension rod is connected to drum axle 106. FIG. 2 illustrates drum extension rod 202 connected to drum axle 106 (drum axle 106 is not visible in FIG. 2). Drum extension rod 202 has a diameter that corresponds with the diameter of drum axle 106, and is able to screw into or otherwise couple with drum axle 106. Drum extension rod 202 also has a length about as long as drum assembly 101. With drum extension rod 202 connected to drum axle 106, drum assembly 101 may be slid off of drum axle 106 and out of printing system 100. FIG. 3 illustrates drum assembly 101 slid out onto drum extension rod 202. In this figure, photoconductive drum 302 is visible as part of drum assembly 101. By sliding drum assembly 101 out onto drum extension rod 202, drum assembly 101 is not allowed to move from its axis and to contact other proximate components. For example, drum assembly 101 is not allowed to contact developer 104 while it is being removed, as developer 104 is at a fixed position in printing system 100. FIG. 4 illustrates printing system 100 with drum assembly 101 removed.

Figure 5:
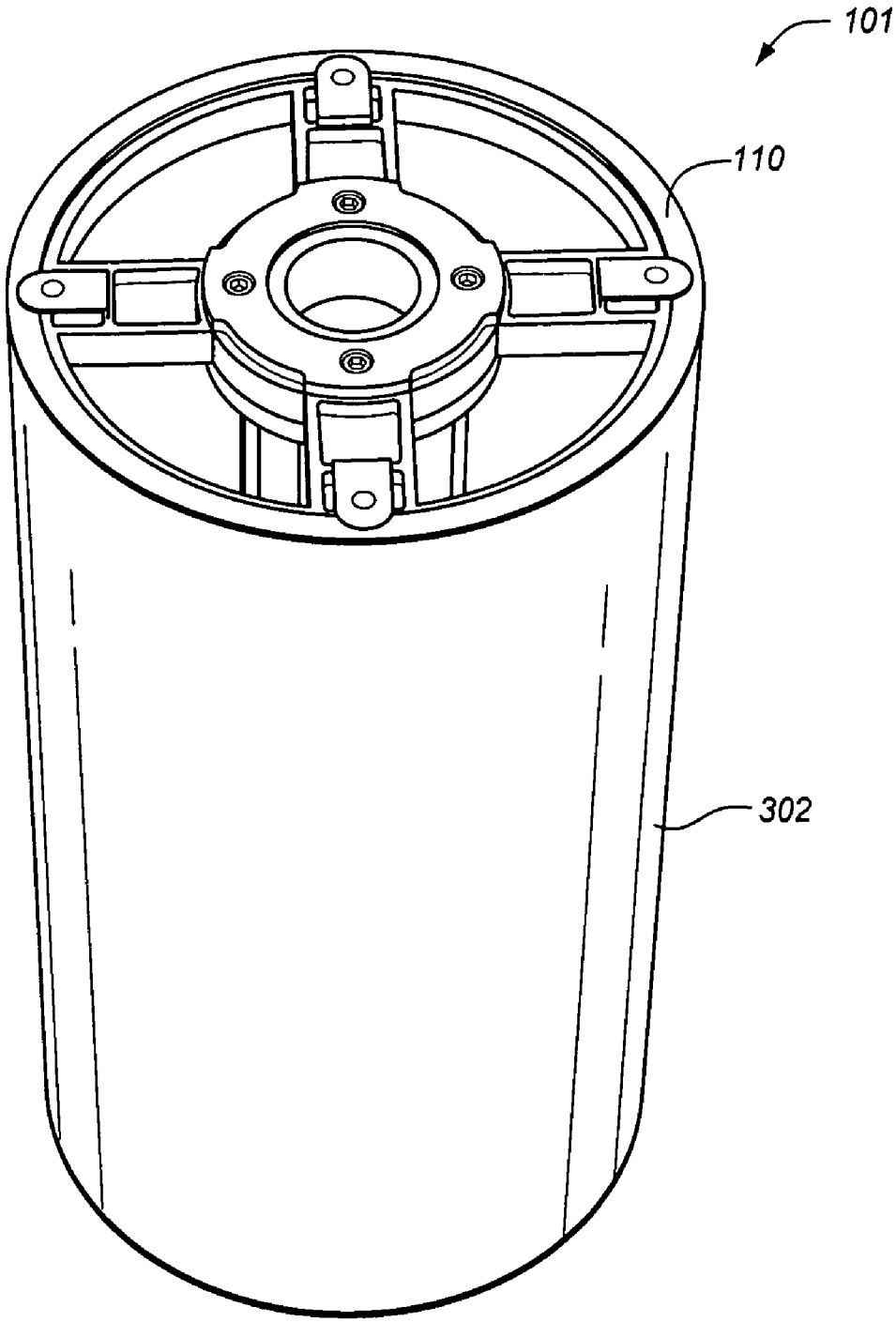
FIG. 5 PRIOR ART
FIG. 5 illustrates a drum assembly as removed from the printing system.
Figure 6:
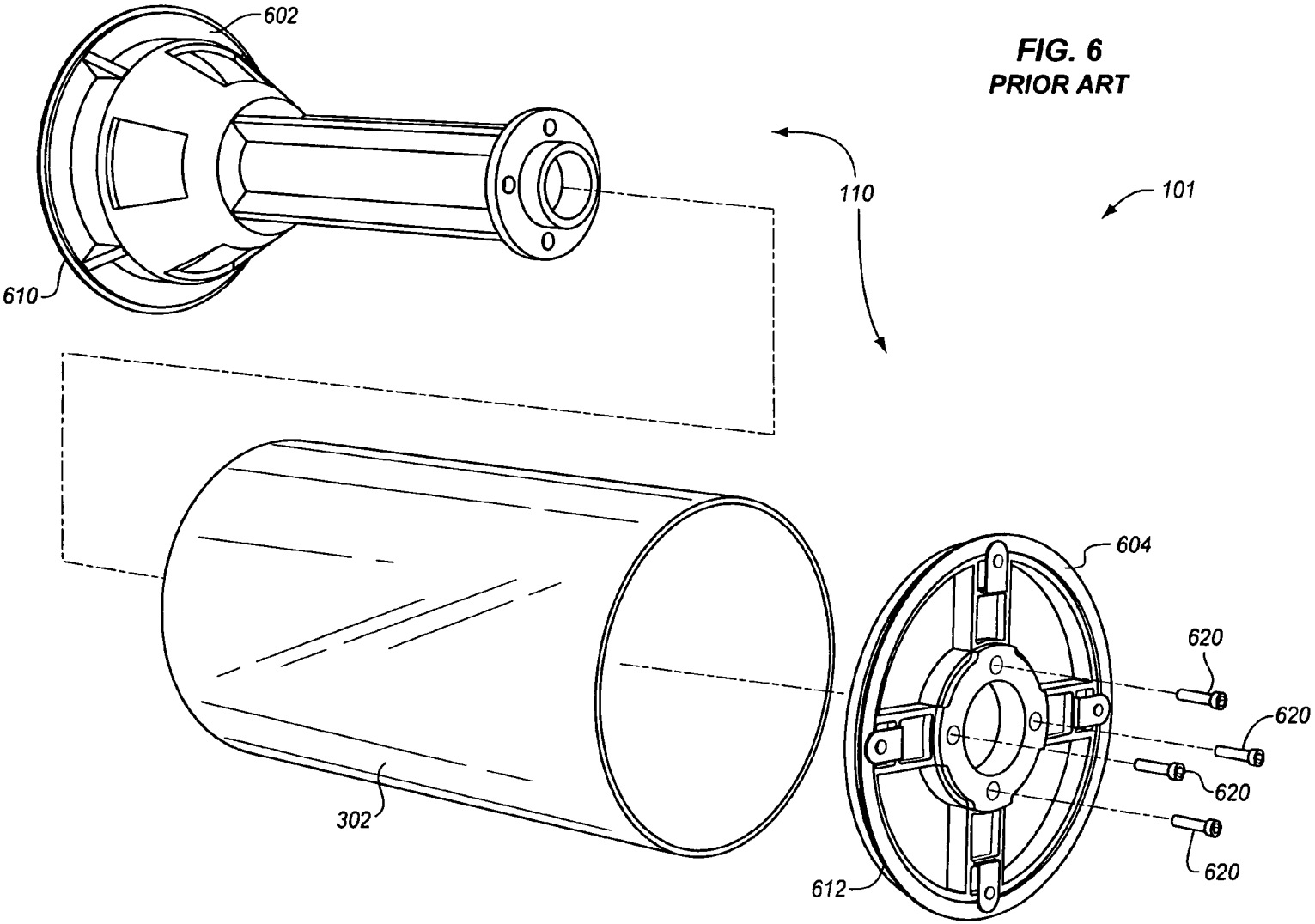
FIG. 6 PRIOR ART
FIG. 6 illustrates an exploded view of a drum assembly.

With drum assembly 101 removed from printing system 100, drum 302 may be replaced in drum assembly 101. FIG. 5 illustrates drum assembly 101 as removed from printing system 100. FIG. 6 illustrates an exploded view of drum assembly 101. Drum assembly 101 includes drum support structure 110 comprised of an inner support member 602 and an outer end cap 604. Inner support member 602 slides onto drum axle 106 (see FIG. 4), and mates with a drive mechanism within printing system 100 that rotates drum assembly 101 at a desired rotational speed. Inner support member 602 has a lip 610 that contacts one end of drum 302. Similarly, outer end cap 604 has a lip 612 that contacts the other end of drum 302. Outer end cap 604 is secured to inner support member 602 by bolts 620. When outer end cap 604 is affixed to inner support member 602, drum 302 is held securely in place.

To remove drum 302 from drum support structure 110, bolts 620 are removed, and outer end cap 604 is disconnected from one end of drum 302. Then, drum 302 may be disconnected from inner support member 602. Next, a new drum 302 may be slid over inner support member 602 to contact lip 610. Outer end cap 604 may again be affixed to inner support member 602, which secures the new drum 302 between inner support member 602 and outer end cap 604. At this point, drum assembly 101 is again assembled with a new drum 302 (see FIG. 5). Drum assembly 101 may then be slid onto drum extension rod 202 (see FIG. 3), and slid into printing system 100 (see FIG. 2). After drum assembly 101 is slid into the proper position within printing system 100, drum extension rod 202 may be removed (see FIG. 1).

The process illustrated in FIGS. 1-6 of replacing drum 302 may be burdensome. First, drum extension rod 202 is needed to properly align drum assembly 101 while it is being slid out of or into printing system 100. Proper alignment is needed so that drum assembly 101 does not contact developer 104 or other delicate components when being slid out of or into printing system 100. Secondly, drum assembly 101 needs to be completely removed from printing system 100 in order to replace drum 302, which takes time and requires lifting of drum assembly 101 which can be quite heavy. Third, wrenches are needed to remove outer end cap 604 from inner support member 602. Fourth, outer end cap 604 and inner support member 602 can get stuck onto the ends of drum 302, and it can be difficult to separate drum 302 from outer end cap 604 and/or inner support member 602. The difficulty of replacing drum 302 unfortunately does not allow a customer to replace drum 302 in an efficient manner. Thus, a service engineer may have to be called to the customer's site to replace drum 302, which may be costly to the customer.

The following embodiments illustrate an improved drum support structure that allows for easier replacement of drum 302.

Figure 7:
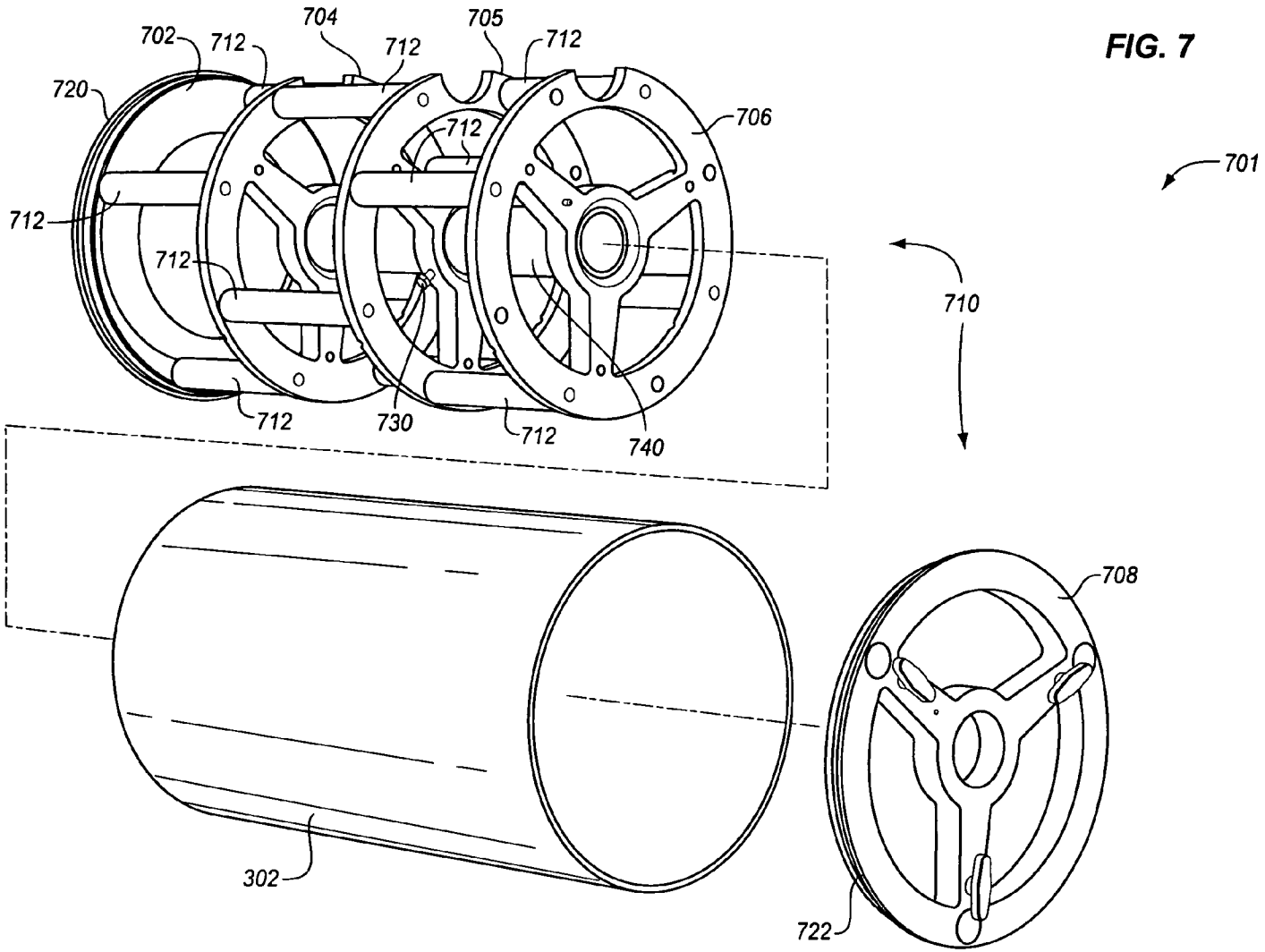
FIG. 7 illustrates an exploded view of a drum assembly in an exemplary embodiment.

FIG. 7 illustrates an exploded view of drum assembly 701 in an exemplary embodiment. Drum assembly 701 includes a drum support structure 710 comprised of an inner end cap 702, one or more ring members 704-706, and an outer end cap 708. To orient the reader, the term "outer" used herein refers to an area or direction towards the outside of printing system 100 where drum assembly 701 may be removed. The term "inner" used herein refers to an area or direction towards the inside of printing system 100.

Figure 8C:
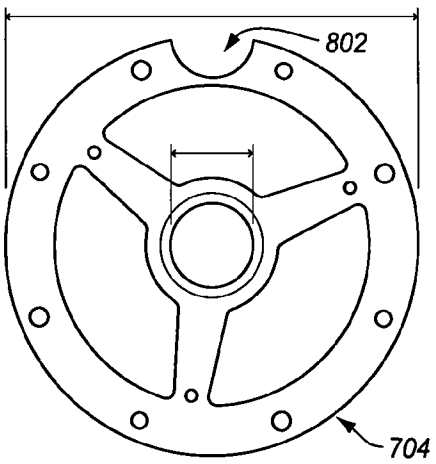
FIGS. 8A-E illustrate a side view of end caps and ring members of a drum assembly in an exemplary embodiment.
Figure 8B:
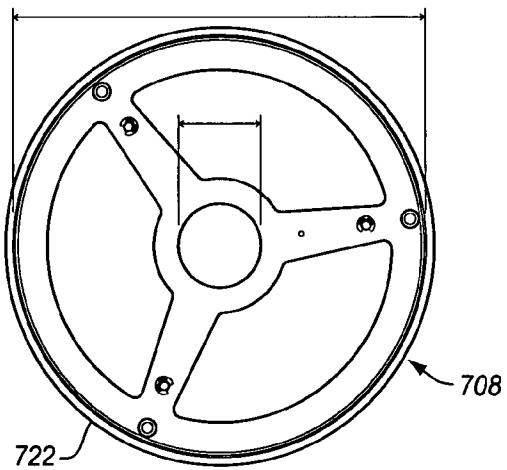
Figure 8A:
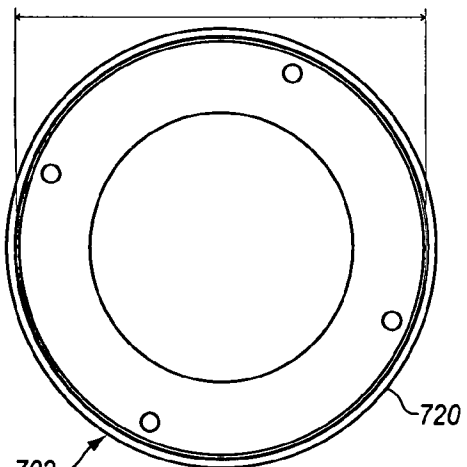

FIGS. 8A-E illustrate a side view of end caps 702 and 708, and ring members 704-706 in an exemplary embodiment. An end cap comprises any circular structure having an outside diameter that fits within a photoconductive drum, and also having a lip, one or more tabs, or some other extension beyond the outside diameter that is able to contact an end of the photoconductive drum. As is shown in FIG. 8A, inner end cap 702 has an outside diameter that fits within drum 302 (see also FIG. 7). Inner end cap 702 also has a lip 720 that extends radially beyond the inside diameter of drum 302 and is adapted to engage with an end of drum 302. As is shown in FIG. 8B, outer end cap 708 has an outside diameter that fits within drum 302 (see also FIG. 7). Outer end cap 708 also has a lip 722 that extends radially beyond the inside diameter of drum 302 and is adapted to engage with another end of drum 302.

Figure 8E:
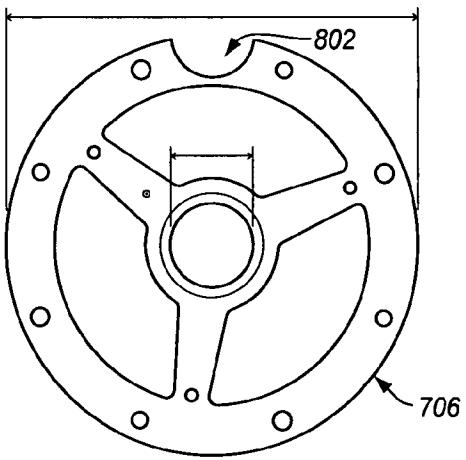
Figure 8D:
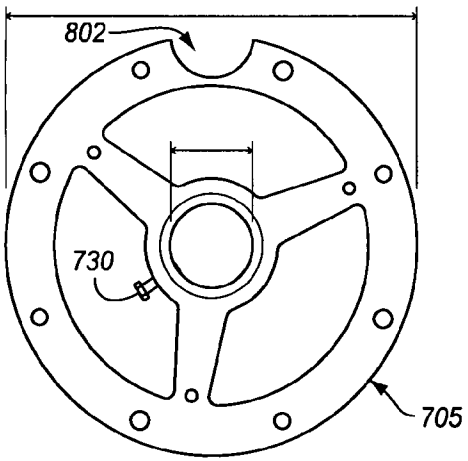

A ring member comprises any circular structure having an outside diameter that fits within a photoconductive drum and substantially contacts the inside surface of the drum. The circular structure of a ring member may also have an inside diameter (also referred to as a shaft diameter or bore diameter) that fits over a drum axle within a printing system. In FIGS. 8C-E, each ring member 704-706 has an outside diameter that fits within drum 302 (see also FIG. 7). An outside diameter may also be referred to as a circumference or an outer surface. Ring members 704-706 also have an inside diameter that fits over drum axle 106 of printing system 100 (see also FIG. 4).

The structure of ring members 704-706 shown in FIGS. 7 and 8A-E illustrate just one embodiment, and the structure of ring members 704-706 may be different in other embodiments. For example, ring member 704 may be a solid member between the outside diameter and the inside diameter instead of having the three arms illustrated in FIGS. 7 and 8C. Additionally, ring members 704-706 may have two arms, four arms, five arms, etc, instead of having three as illustrated in FIGS. 7 and 8C-E.

Ring members 704-706 may also include one or more voids 802 along its outside diameter. Voids 802 allow an operator of printing system 100 to be able to grab the inside surface of drum 302 when it is being removed from drum support structure 710.

In FIG. 7, inner end cap 702 and ring members 704-706 are affixed to one another by connecting members 712. Connecting members 712 affix inner end cap 702 and ring members 704-706 so that they are spaced apart along a longitudinal axis, where inner end cap 702 and ring members 704-706 are oriented transversely with respect to the longitudinal axis so that they are aligned in parallel. With inner end cap 702 and ring members 704-706 aligned in parallel along the longitudinal axis, the outside diameters of the inner end cap 702 and ring members 704-706 are also aligned to form a cylindrical skeleton that is able to fit within drum 302 which is also cylindrical on its inside surface. Although the spacing between inner end cap 702 and ring members 704-706 appears uniform in FIG. 7, other desired spacing may be used.

Connecting members 712 may be affixed to various positions of ring members 704-706. Preferably, connecting members 712 are affixed in such a way that a surface of connecting members 712 is substantially flush with the outside diameter of ring members 704-706. Thus, when drum 302 is slid onto or off of drum support structure 710, the surface of connecting members 712 may also contact the inside surface of drum 302 to keep drum 302 on its axis. Although four connecting members 712 are used to connect each ring member 704-706 to another in this embodiment, more or less connecting members 712 may be used to connect ring members 704-706 to one another in other embodiments.

As can been seen in FIG. 7, ring member 705 may include one or more set screws 730. Set screws 730 may have a knurled top, T-top, or other tool-less configuration so that they may be tightened or loosened by hand. When tightened, set screws 730 protrude into the inside diameter of ring member 705 and contact the drum axle 106 of printing system 100 (see also FIG. 4). The purpose of set screws 730 is described later in relation to FIG. 13.

Drum support structure 710 may also include a sleeve 740 that connects between ring members 704-706. Sleeve 740 comprises a tubular member that fits over drum axle 106 within printing system 100 (see also FIG. 4). Sleeve 740 prevents toner from contaminating drum axle 106 during removal of drum 302. If toner drops onto drum axle 106, then drum support structure 710 might not be slid easily in the longitudinal direction and could seize on drum axle 106.

Figure 9:
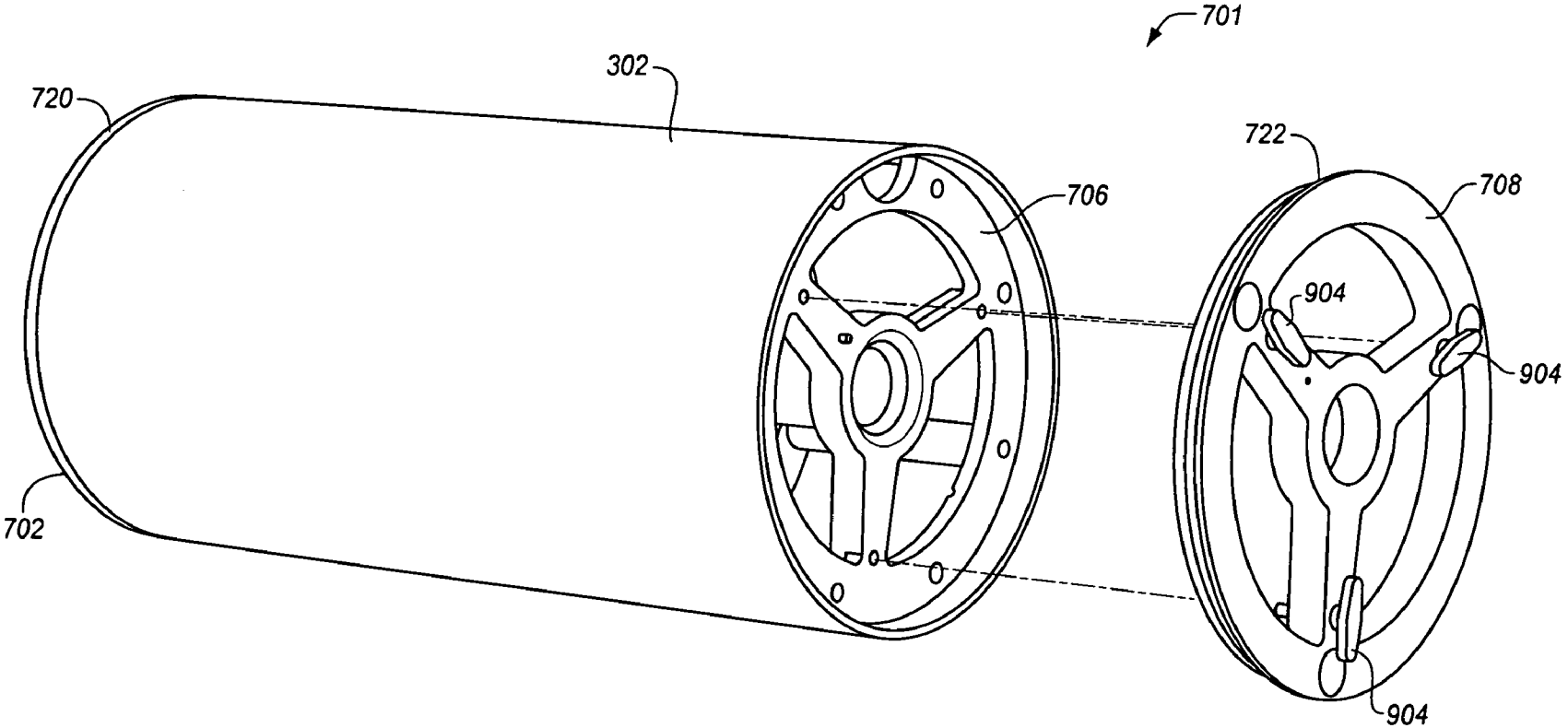
FIG. 9 illustrates a drum slid onto a drum support structure in an exemplary embodiment.

To place drum 302 onto drum support structure 710, drum 302 slides over the outside diameter of ring members 704-706. Drum 302 also slides over the outside diameter of inner end cap 702 until the end of drum 302 contacts or abuts lip 720 that extends beyond the outside diameter of inner end cap 702. FIG. 9 illustrates drum 302 slid onto drum support structure 710 in an exemplary embodiment.

Figure 10:
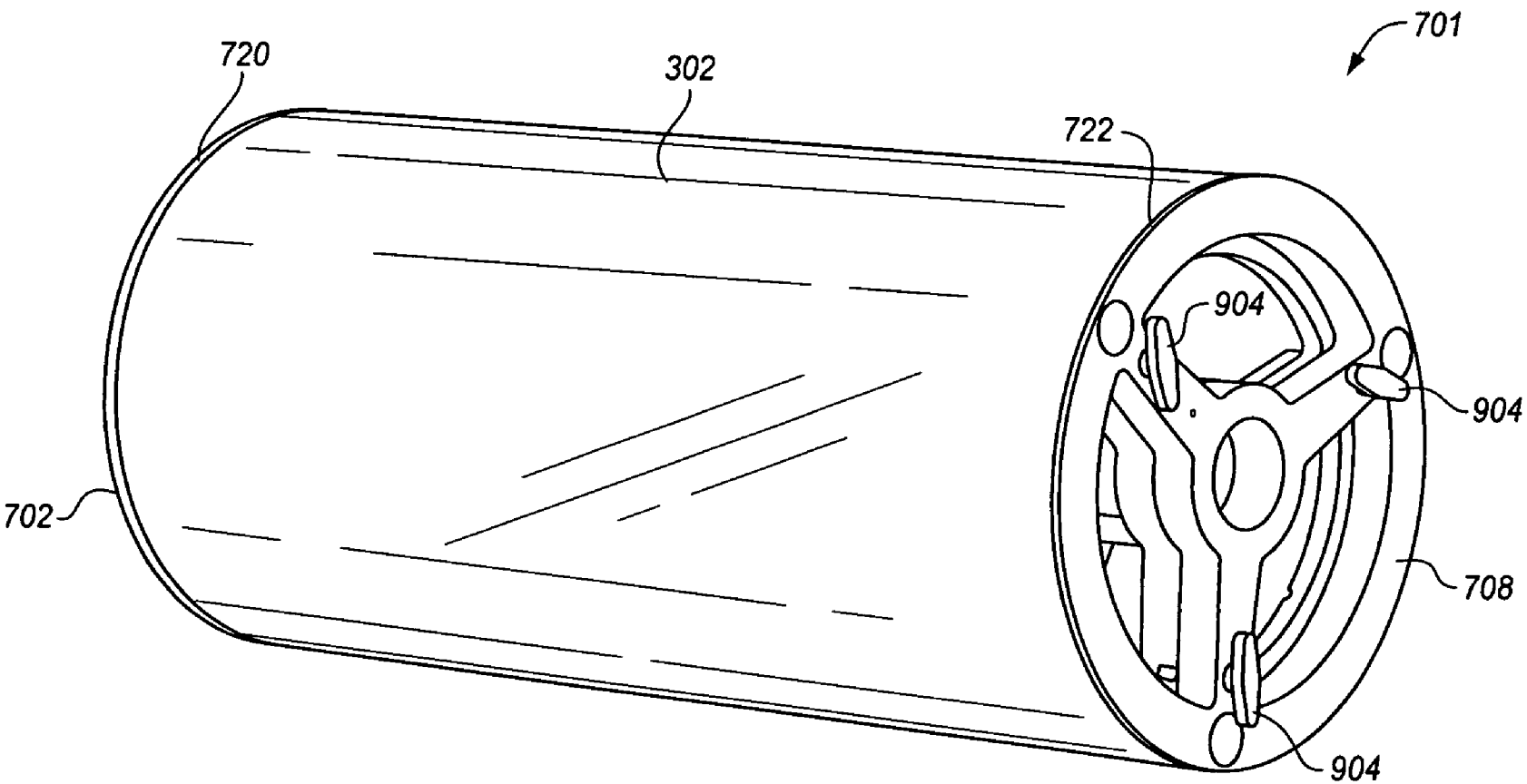
FIG. 10 illustrates a drum attached to a drum support structure in an exemplary embodiment.

Outer end cap 708 is adapted to connect to the outer-most ring member 706. Outer end cap 708 includes one or more screws 904 or other fastening devices that connect outer end cap 708 to outer ring member 706. Screws 904 may have a knurled top, T-top, or other tool-less configuration so that they may be tightened or loosened by hand. When screws 904 are tightened, outer end cap 708 is pulled towards outer ring member 706. The outside diameter of outer end cap 708 slides into drum 302 until the other end of drum 302 contacts or abuts lip 722 that extends beyond the outside diameter of outer end cap 708. This causes drum 302 to be pressed between lip 720 of inner end cap 702 and lip 722 of outer end cap 708, which secures drum 302 onto drum support structure 710. FIG. 10 illustrates drum 302 attached to drum support structure 710 in an exemplary embodiment, which comprises a completed drum assembly 701.

Figure 11:
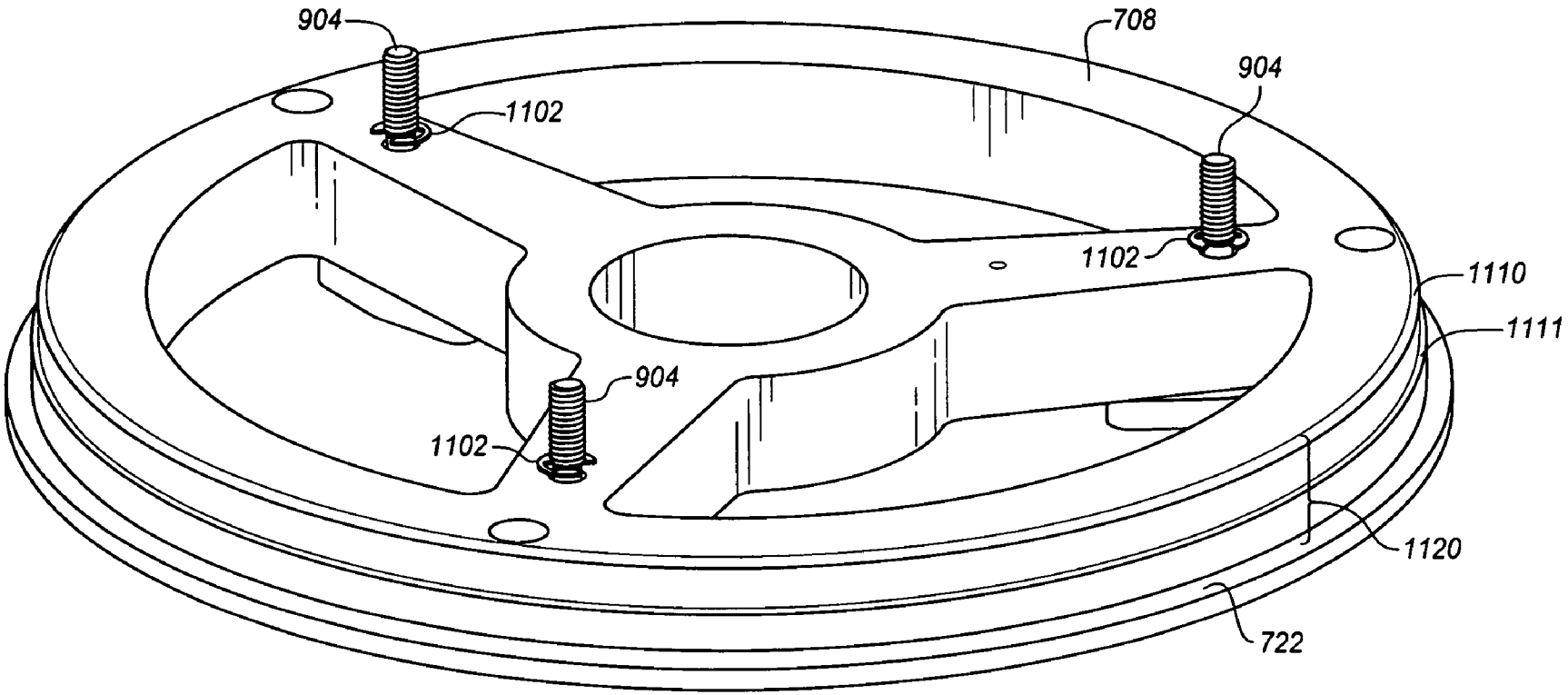
FIG. 11 illustrates an outer end cap in an exemplary embodiment.

In one embodiment, screws 904 in outer end cap 708 not only fasten outer end cap 708 to outer ring member 706, but may also act to pry outer end cap 708 from outer ring member 706 when screws 904 are turned the opposite direction. FIG. 1I illustrates outer end cap 708 in an exemplary embodiment. As can be seen in FIG. 11, a fastener 1102 (also referred to as a locknut, E-clip, or C-clip) is attached behind the threads of screws 904. When screws 904 are turned one direction (presumably clockwise), the threads of screws 904 will screw into a corresponding threaded hole in outer ring member 706. Fasteners 1102 do not interfere with screws 904 being turned into outer ring member 706, as they are attached behind the threads. When screws 904 are turned the opposite direction (presumably counter-clockwise), the threads of screws 904 will screw out of the corresponding threaded hole in outer ring member 706. While screws 904 are screwed out, fasteners 1102 push against outer end cap 708 which acts to pry outer end cap 708 away from outer ring member 706. This assists in separating outer end cap 708 from outer ring member 706 and drum 302.

Also shown in FIG. 11 is that outer end cap 708 has one or more beveled edges 1110-1111 on its outside diameter. The outside diameter of outer end cap 708 is illustrated as reference number 1120. Outside diameter 1120 fits within the inside surface of drum 302, and lip 722 extends beyond outside diameter 1120 so that it may contact one end of drum 302. The edges 1110-1111 are beveled at any desired angle, such as 45 degrees.

Figure 12:
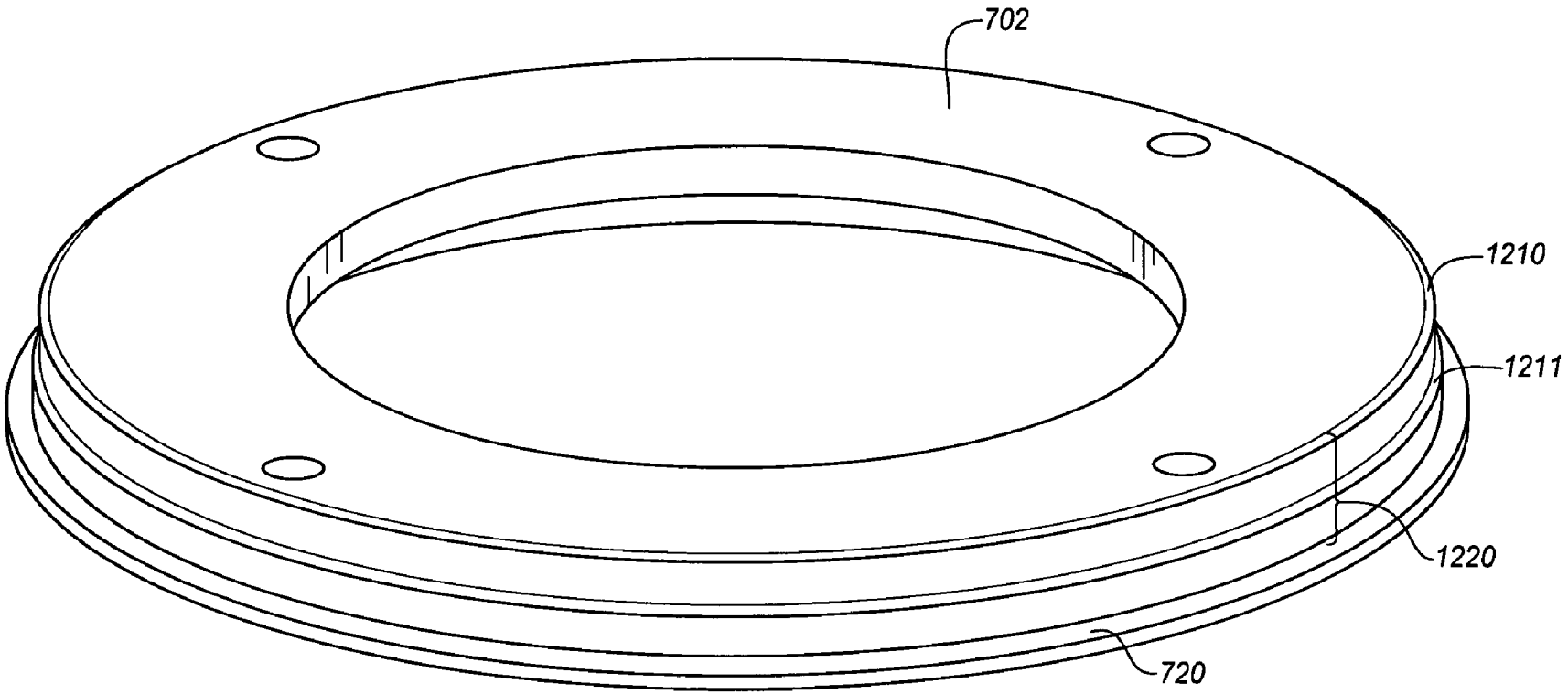
FIG. 12 illustrates an inner end cap in an exemplary embodiment.

FIG. 12 illustrates inner end cap 702 in an exemplary embodiment. As with outer end cap 708, inner end cap 702 has one or more beveled edges 1210-1211 on its outside diameter. The outside diameter of inner end cap 702 is illustrated as reference number 1220. Outside diameter 1220 fits within the inside surface of drum 302, and lip 720 extends beyond outside diameter 1220 so that it may contact one end of drum 302. The edges 1210-1211 are beveled at any desired angle, such as 45 degrees. The advantages of the beveled edges will be described later.

Figure 13:
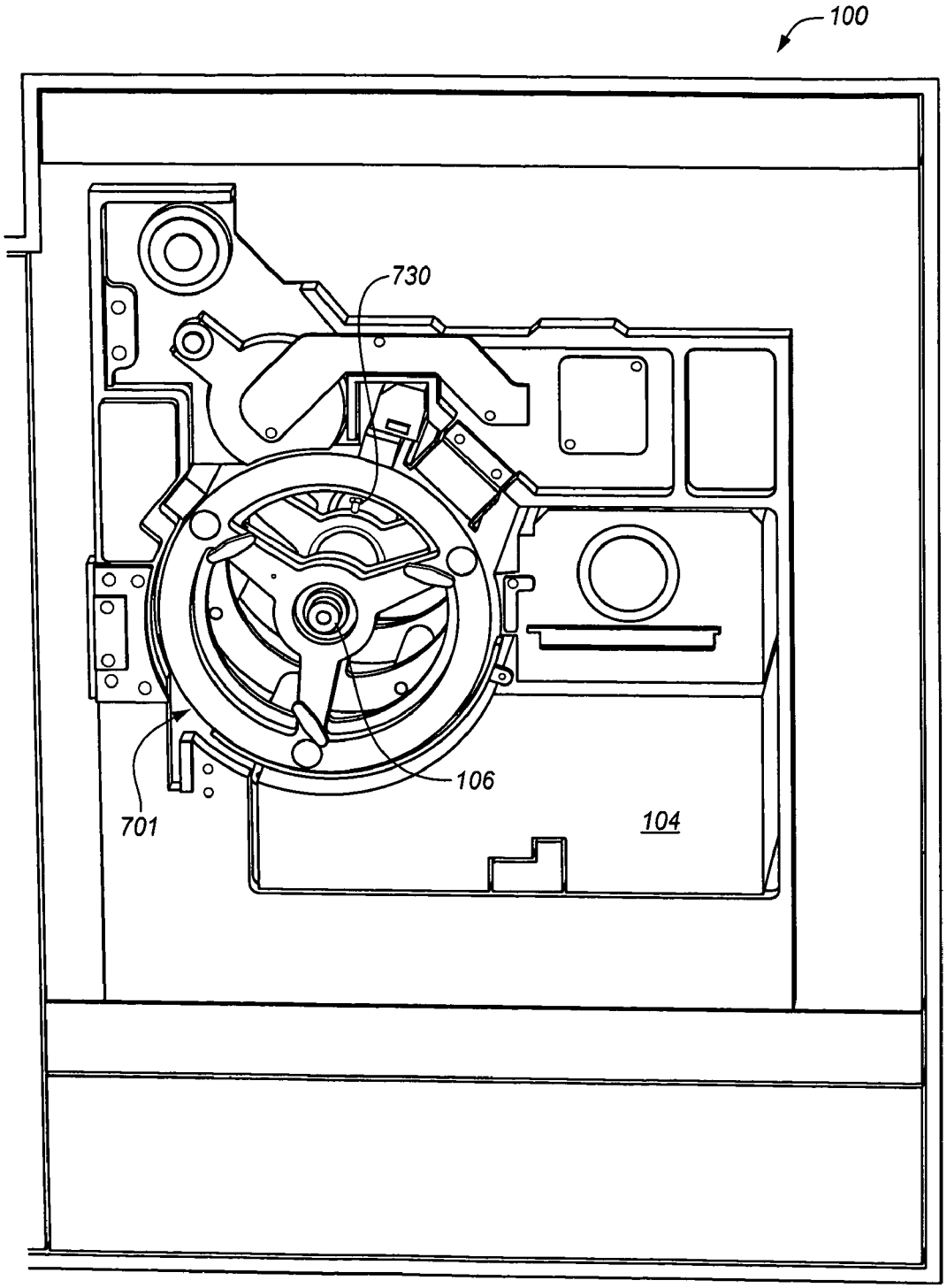
FIG. 13 illustrates a printing system with a drum assembly installed in an exemplary embodiment.

Drum support structure 710 as shown in FIGS. 7-12 allows for drum 302 to be replaced in a more efficient manner within printing system 100. FIGS. 13-18 illustrate how drum 302 may be replaced using drum support structure 710. Assume that drum 302 has been secured onto drum support structure 710 as shown in FIG. 10. Also assume that the resulting drum assembly 701 has been inserted into printing system 100. FIG. 13 illustrates printing system 100 with drum assembly 701 installed in an exemplary embodiment. Assume at this point that an operator of printing system 100 wants or needs to replace drum 302 in drum assembly 701 (see also FIG. 10).

Figure 14:
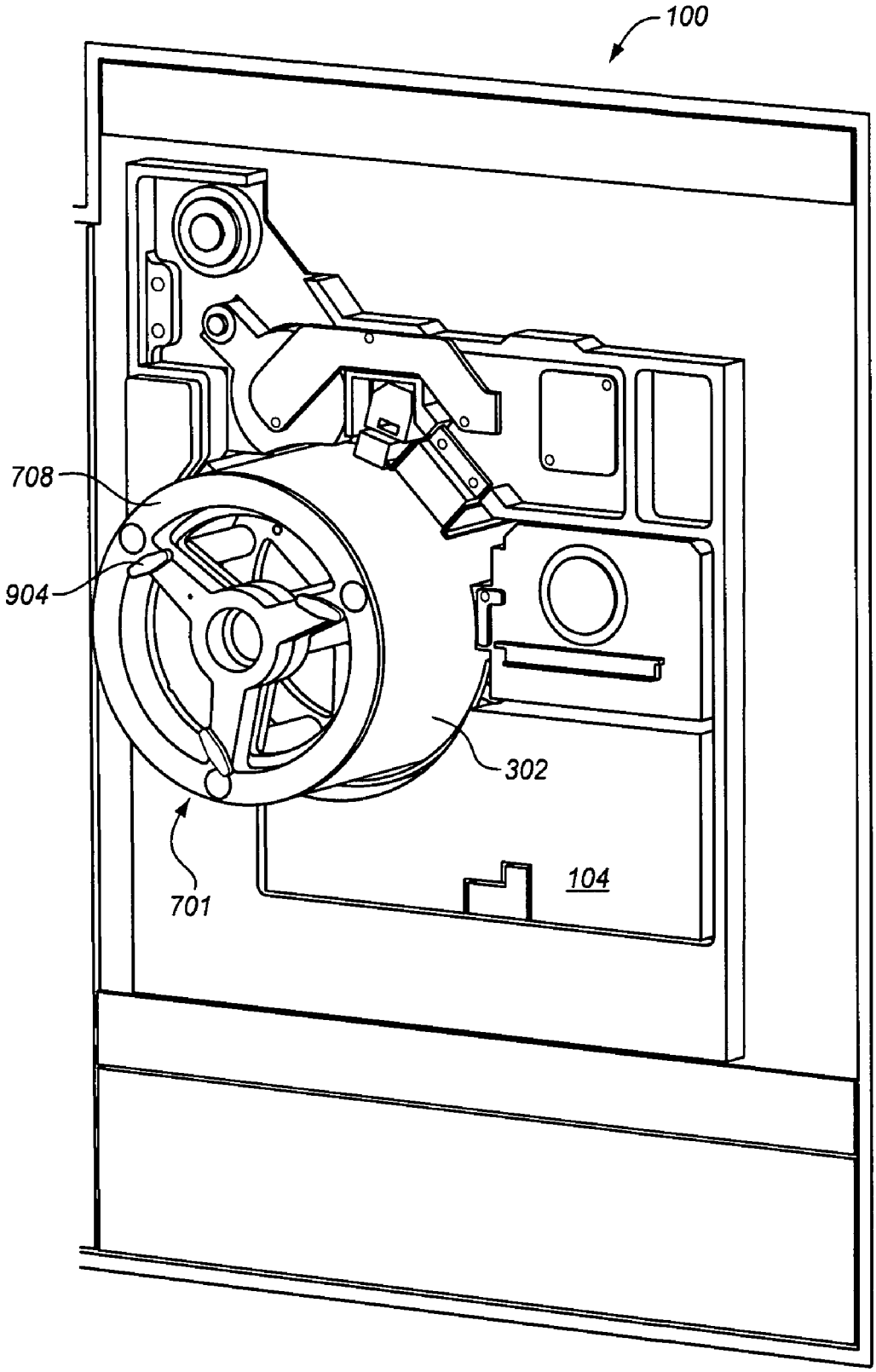
FIG. 14 illustrates a drum assembly slid out of a printing system a threshold distance in an exemplary embodiment.

To start, the operator slides drum assembly 701 out of printing system 100 a threshold distance. In one embodiment, the operator slides drum assembly 701 until ring member 705 is proximate to the end of drum axle 106. Depending on the size of drum assembly 701, this may be in the range of 7-10 inches. FIG. 14 illustrates drum assembly 701 slid out of printing system 100 a threshold distance in an exemplary embodiment. At this point, outer ring member 706 and outer end cap 708 are no longer contacting drum axle 106, and drum assembly 701 is cantilevered out off of drum axle 106.

Figure 15:
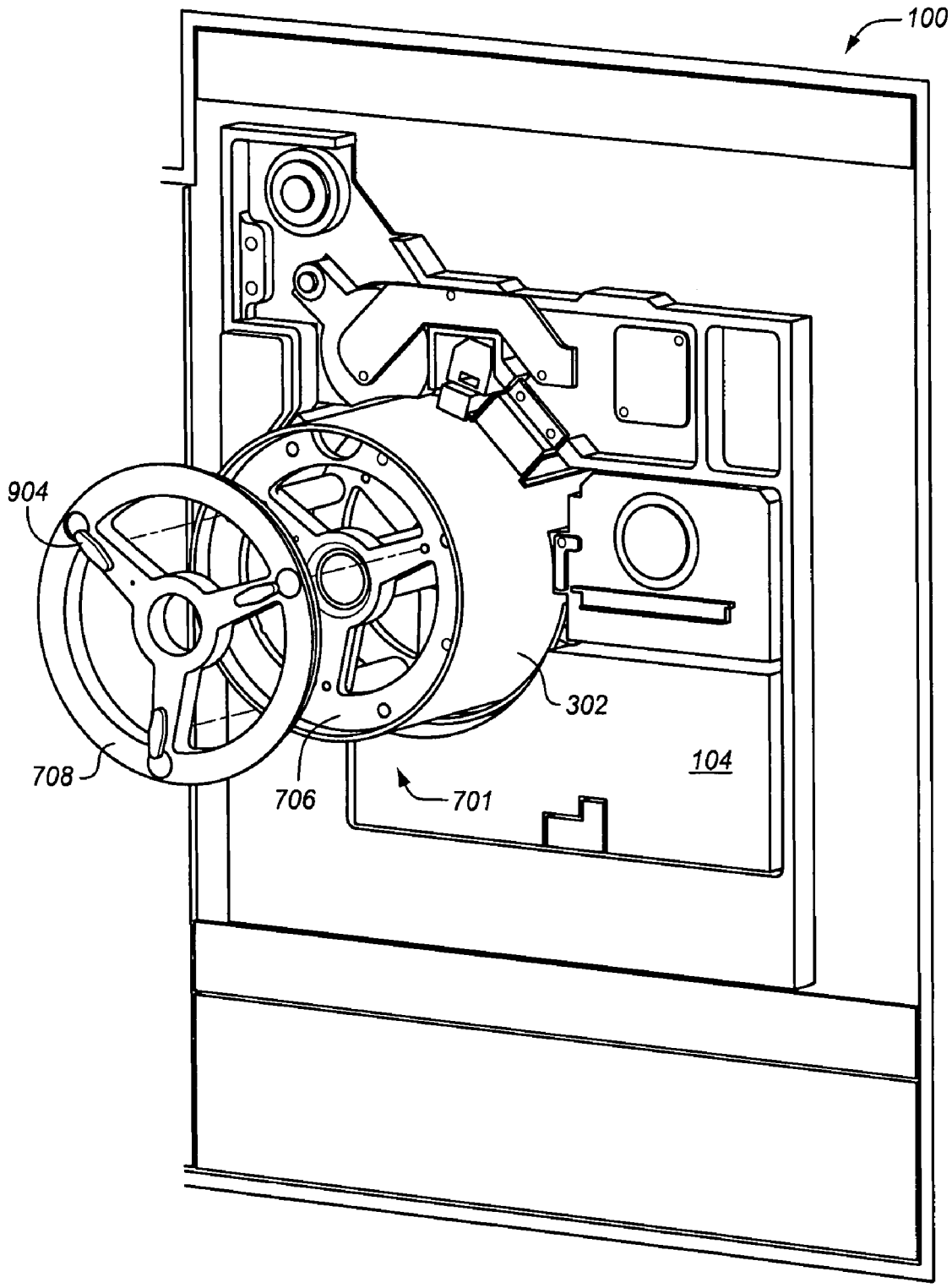
FIGS. 15-16 illustrate an outer end cap removed from a drum assembly in an exemplary embodiment.
Figure 16:
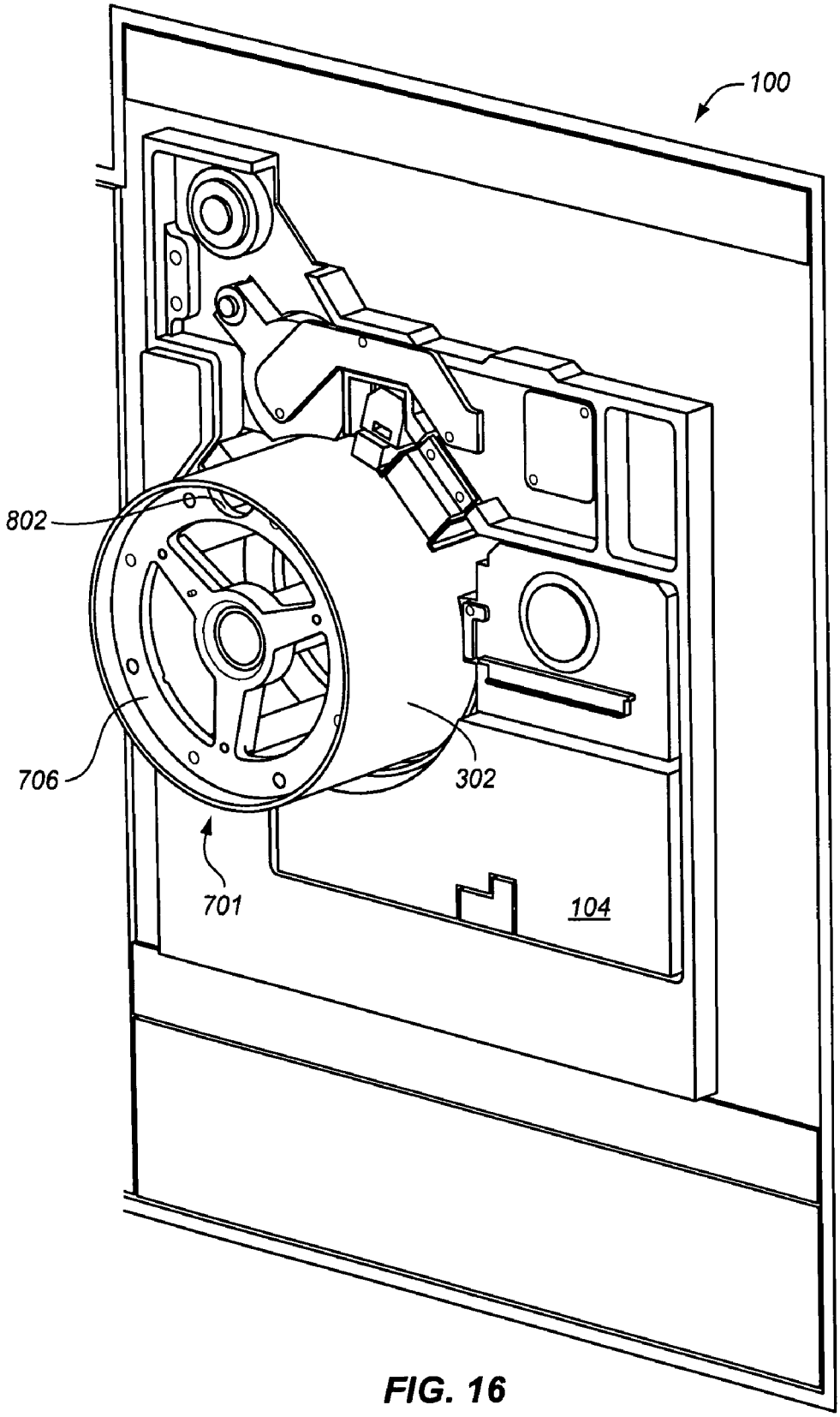

With drum assembly 701 slid out the threshold distance, the operator may tighten one or more of the set screws 730 in ring member 705 (see also FIG. 7). The set screws 730 hold drum assembly 701 from sliding along drum axle 106. The operator may then turn screws 904 in outer end cap 708 to separate outer end cap 708 from outer ring member 706. Outer end cap 708 may then be removed. FIGS. 15-16 illustrate outer end cap 708 removed from drum assembly 701 in an exemplary embodiment.

Figure 17:
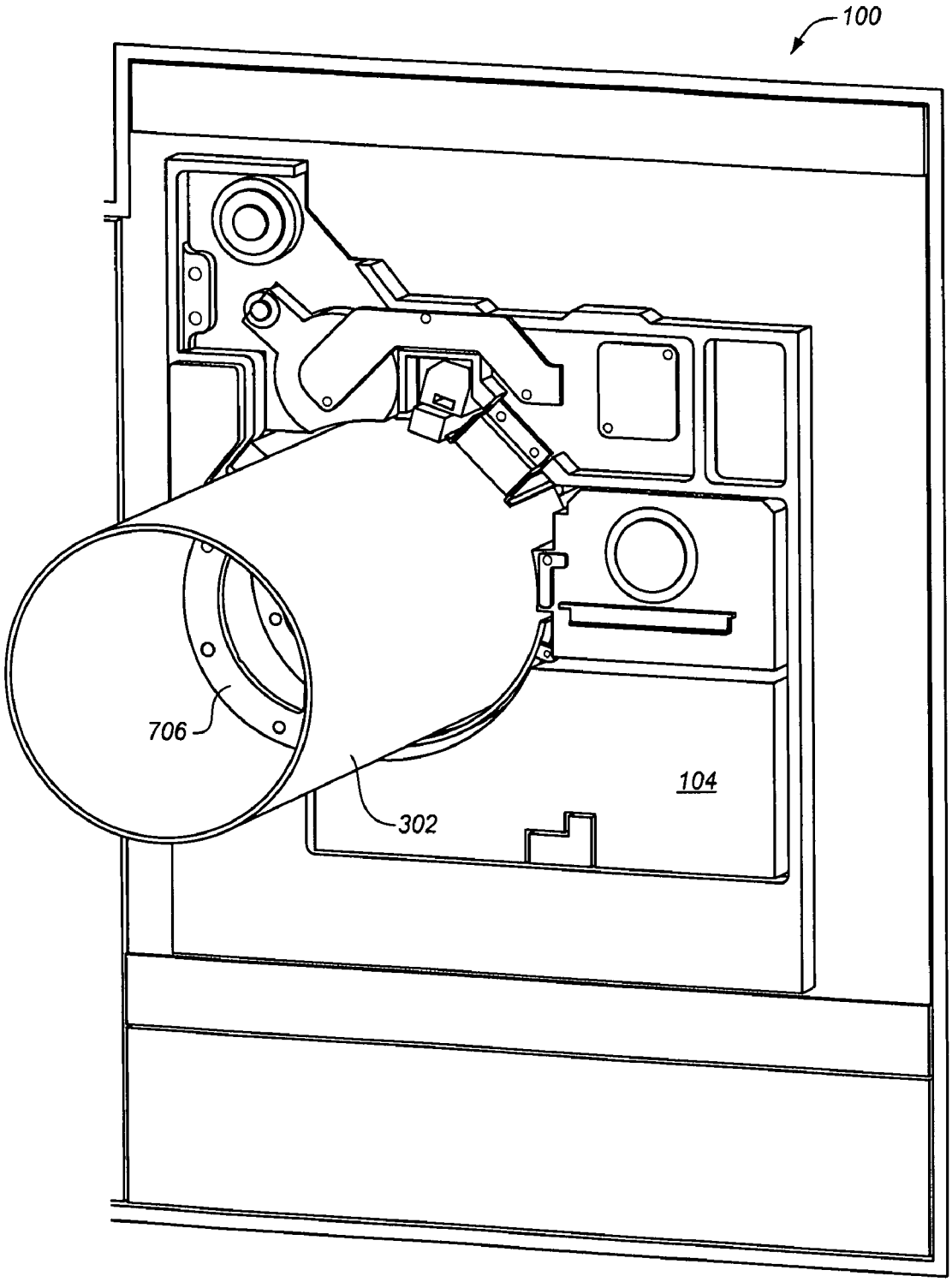
FIG. 17 illustrates a drum partially removed from a drum support structure in an exemplary embodiment.
Figure 18:
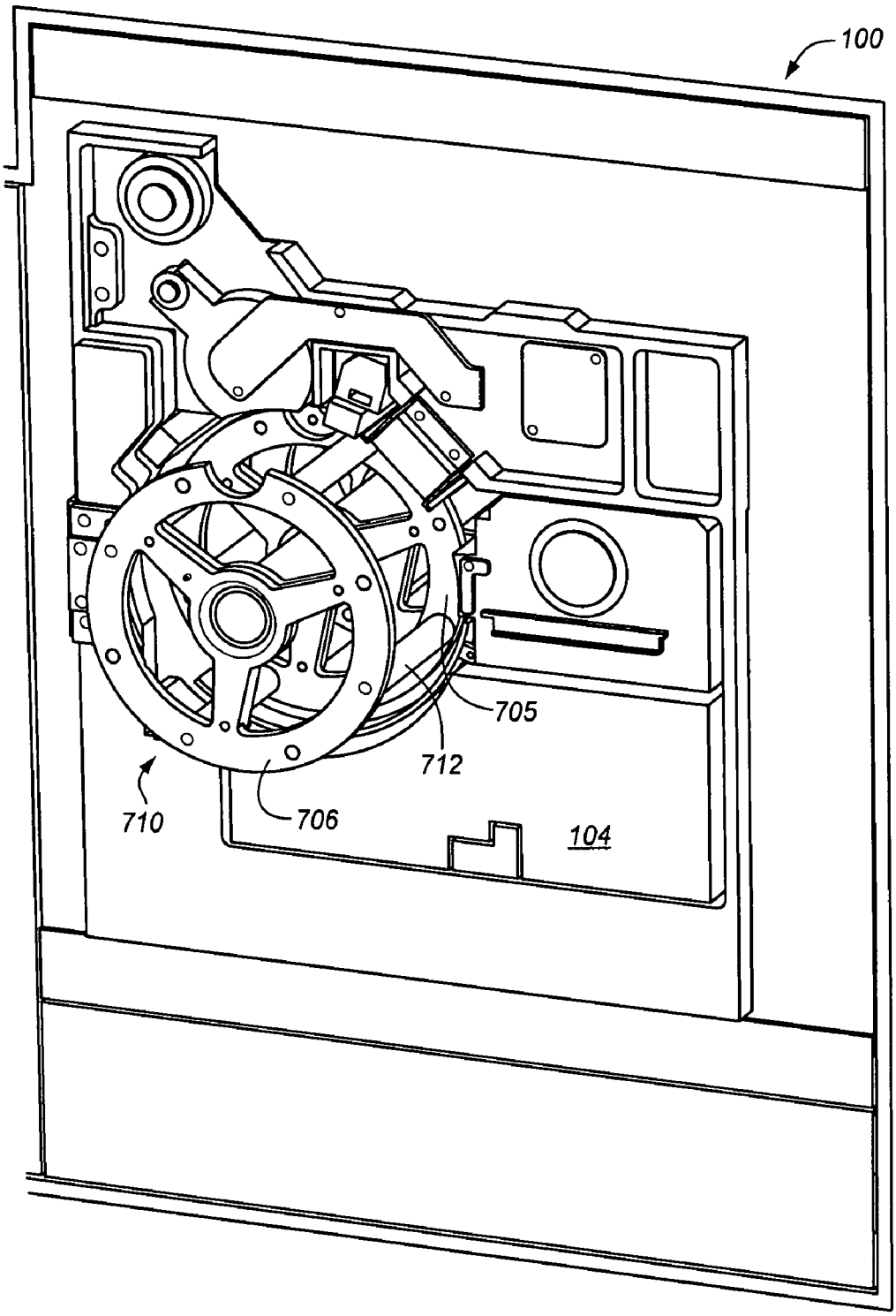
FIG. 18 illustrates a drum removed from a drum support structure in an exemplary embodiment.

With outer end cap 708 removed, the operator may slide drum 302 off of drum support structure 710 (see also FIG. 7). To do so, the operator may reach through void 802 in outer ring member 706 to touch the inside surface of drum 302. The operator may then pull drum 302 off of drum support structure 710 (see also FIG. 7). FIG. 17 illustrates drum 302 partially removed from drum support structure 710 in an exemplary embodiment. The operator may then completely remove drum 302. FIG. 18 illustrates drum 302 removed from drum support structure 710 in an exemplary embodiment.

At this point, the operator may obtain a new drum 302, and slide the new drum 302 onto drum support structure 710 as is illustrated in FIG. 17. The operator slides the new drum 302 onto drum support structure 710 until one end of drum 302 contacts lip 720 of inner end cap 702 (see also FIG. 7). This is illustrated in FIG. 16. The operator may then attach outer end cap 708 to outer ring member 706 using screws 904, as is illustrated in FIGS. 14-15. Lip 722 of outer end cap 708 contacts the other end of the new drum 302 to secure the new drum 302 on drum support structure 710. With outer end cap 708 installed, the drum assembly 701 is again complete. The operator may then loosen the set screws 730 in ring member 705 (see also FIG. 7) so that drum assembly 701 is free to slide on drum axle 106. The operator may then slide drum assembly 701 back into place within printing system 100, which is illustrated in FIG. 13.

Drum support structure 710 advantageously allows the operator of printing system 100 to efficiently replace drum 302. Due to the configuration of drum support structure 710, drum assembly 701 may be partially cantilevered out on drum axle 106 (see FIG. 14). Even while cantilevered, drum support structure 710 stays on its original longitudinal axis on drum axle 106 so that it does not contact other components within printing system 100, such as developer 104. Also, because the ring members 704-706 have an outside diameter that corresponds with the inside diameter of drum 302, the overall shape of drum support structure 710 resembles the shape inside of drum 302. Thus, drum 302 can be slid off of drum support structure 710 without tipping or otherwise going off-axis. If connecting members 712 are affixed to ring members 704-706 flush to the outer diameter of ring members 704-706, then connecting members 712 also assist in keeping drum 302 on axis as it is slid off of drum support structure 710.

Drum 302 may thus be removed from drum support structure 710 without having to remove drum support structure 710 from printing system 100. As shown in FIGS. 3-4, the entire drum assembly 101 had to be removed in order to replace drum 302. With the drum support structure 710 described in the above embodiments, the drum support structure 710 may remain cantilevered on drum axle 106 while the drum 302 is removed and a new drum is inserted, which saves time and alleviates the need to lift an entire drum assembly 701 from printing system 100. Also, no tools are needed to replace a drum 302 on drum support structure 710, which again saves time and means that most customers will be able to change the drums themselves. Thus, there may be no need for a service engineer to come out to the customer site to replace drum 302, which saves the customer on service costs. All of this results in the customer having less down time in replacing a drum 302 within printing system 100.

An additional advantage of drum support structure 710 is provided by the beveled edges on inner end cap 702 and outer end cap 708 as shown in FIGS. 11 and 12. When a new drum 302 is slid onto drum support structure 710 as in FIG. 17, the end of the new drum 302 slides very close to developer 104. Thus, some of the toner stored in developer 104 may collect on the end of the new drum 302 while it is being slid across developer 104. If this happens, the toner is scraped off of the end of the new drum 302 by the beveled edges 1210-1211 of inner end cap 702. This means that it is less likely that toner will get stuck between the end of the new drum 302 and the outside diameter 1220 and/or lip 720 of inner end cap 702. When the new drum 302 subsequently has to be removed from printing system 100, the new drum 302 will be easily separated from inner end cap 702 because little or no toner will be in the connection points of the new drum 302 and inner end cap 702.

Although specific embodiments were described herein, the scope of the invention is not limited to those specific embodiments. The scope of the invention is defined by the following claims and any equivalents thereof.

I claim:

1. A drum support structure for a printing system, the drum support structure comprising:

an inner end cap and a plurality of ring members spaced apart substantially parallel along a longitudinal axis; and a plurality of connecting members that affix the inner end cap and the ring members to one another along the longitudinal axis;

the inner end cap has an outside diameter that fits within a photoconductive drum, and has a lip that extends beyond its outside diameter to contact one end of the photoconductive drum;

the ring members have an outside diameter that fits within the photoconductive drum to substantially contact an inside surface of the photoconductive drum.

2. The drum support structure of claim 1 wherein:

the connecting members are affixed to the inner end cap and the ring members so that a surface of the connecting members is substantially flush with the outside diameter of the inner end cap and the ring members.

3. The drum support structure of claim 1 wherein:

at least one of the ring members has a void along its outside diameter to allow an operator to grasp the inside surface of the photoconductive drum.

4. The drum support structure of claim 1 wherein:

the ring members have an inside diameter that fits over a drum axle within the printing system.

5. The drum support structure of claim 4 wherein:

at least one of the ring members has at least one set screw able to protrude into its inside diameter and contact the drum axle within the printing system.

6. The drum support structure of claim 1 further comprising:

an outer end cap adapted to connect to an outer-most one of the ring members;

the outer end cap has an outside diameter that fits within the photoconductive drum;

the outer end cap has a lip that extends beyond its outside diameter to contact the other end of the photoconductive drum.

7. The drum support structure of claim 6 further comprising:

at least one fastening device adapted to connect the outer end cap to the outer ring member, wherein the at least one fastening device is adapted to tighten the outer end cap toward the outer ring member when turned one direction, and is adapted to pry the outer end cap away from the outer ring member when turned the opposite direction.

8. The drum support structure of claim 6 wherein:

the outside diameter of the outer end cap includes at least one beveled edge.

9. The drum support structure of claim 1 wherein:

the outside diameter of the inner end cap includes at least one beveled edge.

10. The drum support structure of claim 1 further comprising:

a sleeve that fits over a drum axle within the printing system and connects between the ring members.

11. A drum support structure for a printing system, the drum support structure comprising:

a first end cap;

a plurality of ring members spaced apart along a longitudinal axis, wherein the ring members are transversely oriented with respect to the longitudinal axis;

a plurality of connecting members that affix the first end cap and the ring members to one another along the longitudinal axis; and a second end cap adapted to fasten to an outer-most one of the ring members;

the ring members have an outside diameter that fits within a photoconductive drum to substantially contact an inside surface of the photoconductive drum;

the first end cap has a first lip larger than the outside diameter of the ring members that is adapted to contact a first end of the photoconductive drum when the photoconductive drum is slid over the ring members;

the second end cap has a second lip larger than the outside diameter of the ring members that is adapted to contact a second end of the photoconductive drum when second end cap is fastened to the outer ring member.

12. The drum support structure of claim 11 wherein:

the connecting members are affixed to the first end cap and the ring members so that a surface of the connecting members is less than substantially flush with the outside diameter of the first end cap and the ring members.

13. The drum support structure of claim 11 wherein:

at least one of the ring members has a void along its outside diameter to allow an operator to grasp the inside surface of the photoconductive drum.

14. The drum support structure of claim 11 wherein:

the ring members have an inside diameter that fits over a drum axle within the printing system.

15. The drum support structure of claim 14 wherein:

at least one of the ring members has at least one set screw able to protrude into its inside diameter and contact the drum axle within the printing system.

16. The drum support structure of claim 11 further comprising:

at least one fastening device adapted to connect the second end cap to the outer ring member, wherein the at least one fastening device is adapted to tighten the second end cap toward the outer ring member when turned one direction, and is adapted to pry the second end cap away from the outer ring member when turned the opposite direction.

17. The drum support structure of claim 11 wherein:

the outside diameter of the second end cap includes at least one beveled edge.

18. The drum support structure of claim 11 wherein:

the outside diameter of the first end cap includes at least one beveled edge.

19. The drum support structure of claim 11 further comprising:

a sleeve that fits over a drum axle within the printing system and connects between the ring members.

20. A drum support structure for a printing system, the drum support structure comprising:

a plurality of ring members spaced apart along a longitudinal axis and transversely oriented with respect to the longitudinal axis, wherein the ring members have an outside diameter that corresponds with an inside diameter of a photoconductive drum so that the ring members fit within the photoconductive drum;

a plurality of connecting members that affix the ring members to one another along the longitudinal axis and define the spacing between the ring members;

an inner end cap that connects to an inner-most ring member through at least one of the connecting members and that has a first lip that extends radially beyond the inside diameter of the photoconductive drum to contact one end of the photoconductive drum; and an outer end cap that is adapted to fasten to an outer-most ring member and that has a second lip that extends radially beyond the inside diameter of the photoconductive drum to contact another end of the photoconductive drum.

* * * * *